United States Patent [19]

Evangelista, Jr.

[11] Patent Number: 4,569,057

[45] Date of Patent: Feb. 4, 1986

[54] MATERIAL FEED SYSTEM FOR SMELTING FURNACES

[75] Inventor: Dominic Evangelista, Jr., Pittsburgh, Pa.

[73] Assignee: Pennsylvania Engineering Corporation, Pittsburgh, Pa.

[21] Appl. No.: 624,528

[22] Filed: Jun. 25, 1984

[51] Int. Cl.[4] ..... F27D 3/10; F27D 3/12

[52] U.S. Cl. ..... 373/81; 414/160; 414/162; 414/171

[58] Field of Search ..... 373/79, 80, 81; 414/160, 162, 165, 171, 179, 180, 189, 198; 432/243

[56] References Cited

U.S. PATENT DOCUMENTS

| | | | |
|---|---|---|---|
| 2,227,416 | 3/1942 | Rutten . | |
| 2,721,665 | 10/1955 | Goeke . | |
| 3,095,098 | 6/1963 | Maaloe . | |
| 3,145,885 | 8/1964 | Plugge et al. . | |
| 3,205,859 | 9/1965 | Fine et al. . | |
| 3,760,960 | 9/1973 | Schumacher et al. | 373/81 |
| 3,856,129 | 12/1974 | Bauer et al. . | |
| 4,142,880 | 3/1979 | Wenda et al. | 414/165 |
| 4,399,546 | 8/1983 | Phillips | 373/115 |
| 4,402,083 | 8/1983 | Paskarbeit et al. | 373/81 |
| 4,487,578 | 12/1984 | Wakino et al. | 432/243 |

*Primary Examiner*—Roy N. Envall, Jr.
*Attorney, Agent, or Firm*—Fred Wiviott

[57] ABSTRACT

A feed system for a smelting furnace having a plurality of feed chutes arranged in a spaced apart, circular array. The feed system includes a circular conveyor mounted adjacent the furnace and concentrically with the feed chutes. The conveyor also has a gap therein which permits the discharge of material downwardly into the feed chutes and means for rotating the conveyor about its axis of curvature to sequentially position the gap above successive feed chutes. In addition, one or more feed hoppers are positioned above the conveyor for depositing feed materials thereon.

18 Claims, 4 Drawing Figures

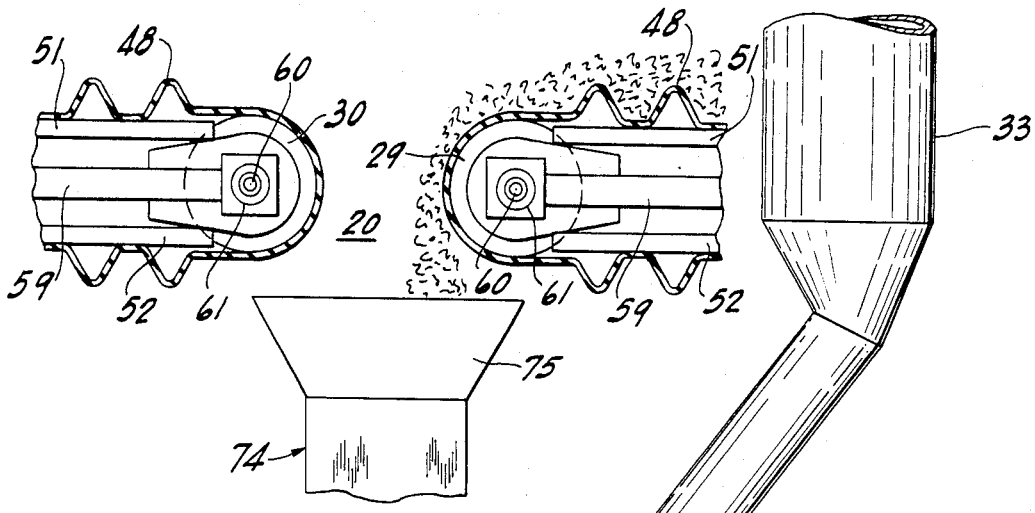
Fig. 4
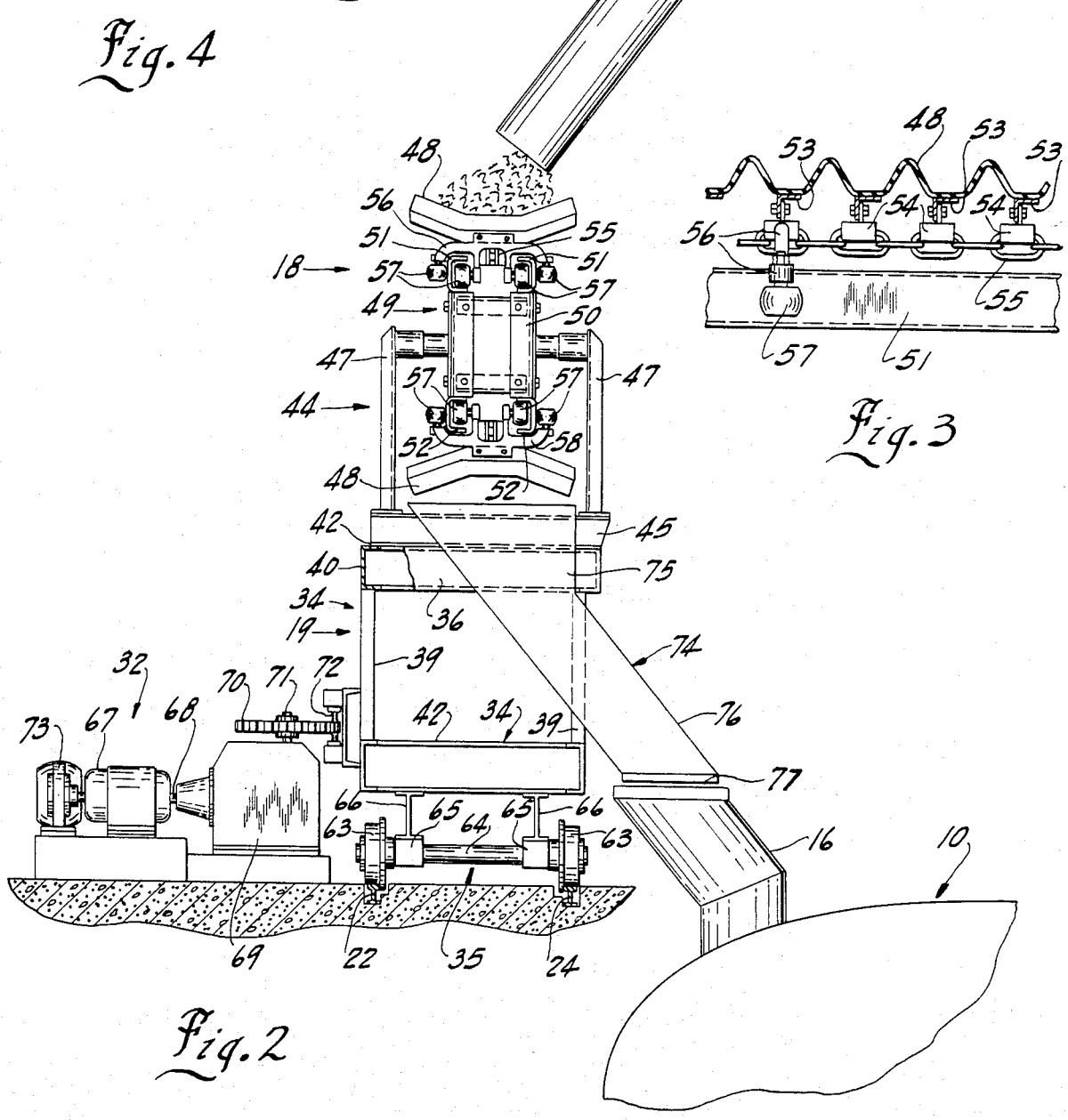
Fig. 2
Fig. 3

MATERIAL FEED SYSTEM FOR SMELTING FURNACES

BACKGROUND OF THE INVENTION

This invention relates to feed systems for electric arc smelting furnaces and more particularly to a feed system which permits delivery of feed material to chutes distributed around the roof of an electric arc smelting furnace.

Electric arc furnaces are employed for smelting the ores of various substances, such as nickel, phosphorous, silicon and the like. Such furnaces generally comprise a furnace hearth and an arched roof through which one or more electrodes extend. The heat necessary to promote the chemical reactions required for the smelting process is generated by electric arcs struck between the electrodes or between the electrodes and the furnace charge. During the smelting process, it is necessary to charge additional materials, such as coke or the like, into the furnace. Conventional furnaces may include one or more feed hoppers coupled to chutes which extend through the furnace roof. In this manner, material may be charged into the furnace from time to time.

Prior art systems for charging materials into smelting furnaces tended to deliver the material to a few locations. Other systems which included a plurality of feed chutes distributed around the furnace roof included a plurality of belt type conveyors running from a distribution hopper to each of the feed chutes.

SUMMARY OF THE INVENTION

It is an object of the invention to provide a new and improved feed system for smelting furnaces.

Another object of the invention is to provide a feed system for smelting furnaces which permits the delivery of material to plural feed chutes extending from the furnace roof with a single conveyor.

Another object of the invention is to provide a feed system for smelting furnace which does not require multiple transfer points and which is functional in low head room conditions.

A further object of the invention is to provide a feed system for electric arc smelting furnaces which may be used with a wide range in the number of feed chutes.

Yet another object of the invention is to provide a feed system for electric arc smelting furnaces which is simpler and less costly than prior art systems.

A still further object of the invention is to provide a feed system for electric arc smelting furnaces which requires less power for operation than prior feed systems.

These and other objects and advantages of the invention will become more apparent from the detailed description thereof taken with the accompanying drawings.

In general terms, the invention comprises a feed system for a treatment furnace having a plurality of feed receiving means disposed in a generally circular array for receiving feed materials and delivering the same to spaced apart locations within the furnace. The feed system includes a transporter mounted adjacent the furnace for movement in an arcuate path having a center of curvature coincident with the circular array of the feed receiving means and conveying means mounted on the transporter and movable thereon in a generally horizontal, arcuate path coincident with the center of curvature. Feeding means are disposed adjacent the arcuate path of the conveying means for depositing materials thereon. The conveying means includes an arcuate center portion and end portions on the support means defines a transition in the direction that the conveyor belt means moves so that the material deposited on the belt means will be translated to the discharge means and discharged from the belt means. The support means is rotatable about the axis of curvature of the path that the conveyor belt means moves whereby the discharge means may be selectively positioned adjacent each of the material receiving means so that material deposited on the conveyor belt means may be discharged into selective ones of the receiving means.

BRIEF DESCRIPTION OF THE DRAWINGS

FIG. 2 is a side elevational view, partly in section of the feed system according to the present invention; FIGS. 3 and 4 are fragmentary views of the apparatus shown in FIG. 1.

DETAILED DESCRIPTION OF THE PREFERRED EMBODIMENT

Figure 1:
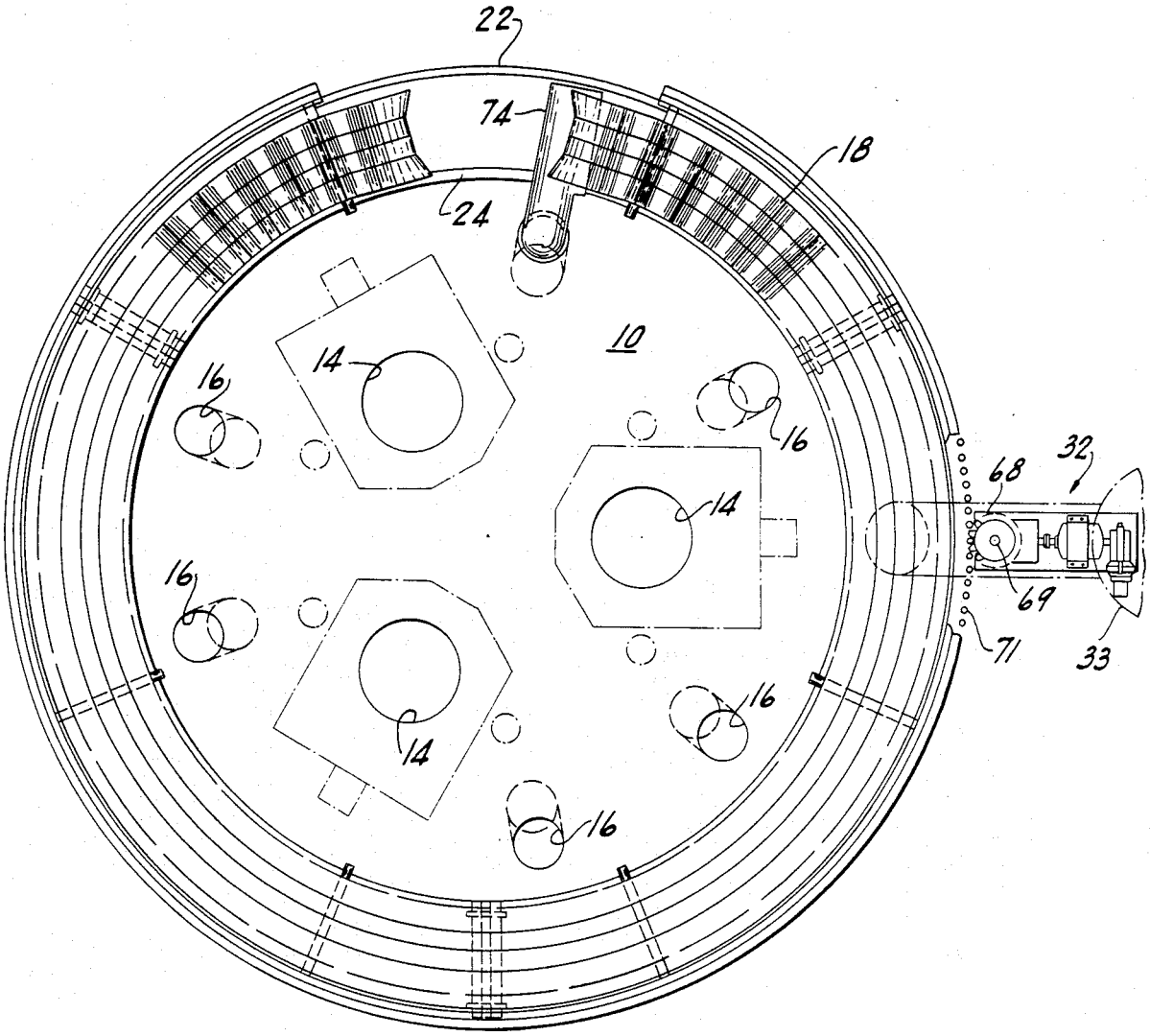
FIG. 1 is a top plan view of an electric arc furnace roof upon which the feed system in accordance with the present invention is installed.

FIG. 1 shows an arc furnace roof 10 upon which the conveyor system 12 of the invention may be mounted. Those skilled in the art will appreciate that smelting furnace roofs are normally arched and that a dished furnace hearth (not shown) is disposed below the roof for receiving the furnace charge. The hearth and roof each normally include a metallic shell and a refractory lining whose chemical composition is dictated by the material being treated. Extending through openings in the furnace roof 10 are a plurality of electrodes 14. While three electrodes arranged in a triangular array are shown, it will be appreciated that the invention has application to furnaces having any number of electrodes or electrodes which arranged differently. Those skilled in the art will also appreciate that the electrodes 14 will normally be of a graphite material and may be self baked or precast. Also, each electrode is normally supported by an electrode positioning and slipping apparatus which is not shown, but is well known in the art.

Also extending through the roof 10 are a plurality of feed chutes 16 which are arranged in a circular array with a pair of chutes being disposed in the roof sector between adjacent the electrodes and between a circle defined by the axes of the electrodes and the outer periphery of the roof 10. While six feed chutes are shown, the invention may be employed with any number of chutes. Also, while it is preferred that the pairs of chutes and the chutes of each pair be equally spaced apart, such spacing is not essential. The conveyor system 12 generally includes a conveyor 18 which is mounted on a car 19 having an annular configuration in plan view as shown in FIG. 1, except for a gap 20. The car 19 is mounted on track means which may comprise spaced apart concentric annular tracks 22 and 24 which are supported on a platform 25 which surrounds the outer periphery of the furnace roof 10. It will also be appreciated that the car may also be mounted on a mono-rail. The car 19 includes upper and lower tracks 26 and 27 which support the conveyor belt 18. A pair of pulleys 29 and 30 are mounted at the opposite sides of the gap 20. The belt 18 passes from the lower track 27 around pulley 30 to the upper track 26 along the upper track 26, around the pulley 29 to the lower track 27. A drive 32 is coupled to the car 20 so that the latter may be sequentially stepped to place the gap 21 successively at the feed chutes 16. At one side of the furnace roof 10 is a hopper 33 for depositing a measured quantity of material on the belt 18. Premeasured materials can also be deposited directly on the belt 18 from a feed conveyor (not shown).

The car 19 includes a frame 34 and a plurality of trucks 35 which engage the tracks 22 and 24. Frame 34 consists of upper and lower arcuate sections 36 and 37 which are coupled in a parallel spaced apart relation by vertical members 39 extending therebetween. The sections 36 and 37 are substantially circular except for the gap 20 and may be fabricated in any suitable manner such as by side angle members 40 and top and bottom plates 42.

Mounted atop the upper section 36 of frame 34 is a conveyor support 44 consisting of a base 45 affixed to the upper surface of section 36 and a plurality of pairs of members 44 which extend vertically upward from the opposite sides of the base 45. While any suitable conveying or system may be employed, the illustrated embodiment with conveyor 18 includes a belt 48 and a track system 49 having an arcuate frame 50 supported between the members 47 and extending around the car 19. Mounted at the upper and lower ends of frame 50 are pairs of upper and lower spaced apart channel members 51 and 52 which define upper and lower tracks. Belt 48 is formed of a suitable flexible material and has a plurality of spaced transverse ribs 53 affixed to its lower surface. A coupler 54 is affixed to each rib 53 and engages a continuous chain 55 extending around the upper and lower ends of frame 50. In addition, spaced apart ones of the couplings 54 include a roller assembly 56 having a plurality of rollers 57 mounted on supports 58. The rollers engage the tracks 51 and 52 which extend along the upper and lower ends of the frame 50.

The pulleys 29 and 30 are contoured complimentary to the conveyor belt 48 and each is rotatably mounted between support arms 60 by means of shafts 61 and bearings 62. The arms 60 extend horizontally in spaced apart relation on the ends of the frame 50 and on the opposite sides of the gap 20. Each pulley also includes a sprocket (not shown) which engages the chain 56. One of the shafts 61 is suitably driven by a motor (not shown) for driving one pulley while the other idles.

The trucks 35 each include a pair of wheels 63 mounted on the shaft 64 rotatably received in bearing 65 supported by brackets 66 extending downwardly from the lower section 67 of car frame 34.

The drive assembly 32 includes a motor 67 mounted outwardly of the tracks 22 and 24 and coupled by a shaft 68 to a speed reducer 69. A sprocket 70 is mounted on an output shaft 71 extending upwardly from speed reducer 69 and meshes with a sprocket chain 72 mounted along the side of the car 19 and extending substantially from one end to the other. The motor output shaft 68 may also be coupled to a suitable brake, such as, magnetic brake 73.

A coupling chute 74 is also mounted on car 19 and is disposed in the gap 20. Chute 74 includes an upper funnel shaped portion 75 and a downwardly and inwardly extending tubular portion 76. The lower end of the 77 of tubular portion 75 is positioned to be in registry with the upper end of the chutes 16 which are mounted on the furnace roof.

In operation, the drive 32 sequentially steps the car 16 to position the gap 21 in alignment with the opened upper end of one of the feed chutes 16. This will place the lower of lower end 76 of the chute 72 above the opened end of one of the chutes 16 mounted in the furnace roof. The hopper 32 is then operated to place a measured quantity of feed material on the upper surface of the running conveyor 18. The pulley 29 is driven to carry the feed material to the gap 20 whereupon it is deposited in the upper portion 74 of chute 73 and flows downwardly to the feed chute 16. This process may be repeated to place measured quantities of the feed material into each of the feed chutes 16 so that the feed material is distributed over the surface of the melt disposed within the furnace hearth. It will be appreciated that the deposit of material on the conveyor 18 and the movement of the conveyor gap 20 to each feed station can be automated or manually operated.

While only a single embodiment of the invention has been illustrated and described, it is intended to be limited only to the scope of the appended claims.

We claim:

1. A feed system for a treatment furnace having a plurality of feed material receiving means disposed in a generally circular array for receiving feed materials and delivering the same to spaced apart locations within the furnace, said feed system including:

a transporter, an arcuate conveying means mounted on said transporter and having a center of curvature coincident with the center of the circular array of said feeding means, said conveying means being mounted on said transporter and having an arcuate center portion and a pair of end portions said conveying means being movable on said transporter in a generally horizontal arcuate path which defines the arcuate shape of the conveying means, feeding means disposed adjacent the arcuate path of the conveying means for depositing materials thereon, said conveying means being constructed and arranged to move feed materials deposited on said central portion to one of said end portions and relative to said transporter so that feed material deposited on the conveying means will be translated to the one end portion and discharged from the conveying means, the transporter being mounted for movement in an arcuate path concentric with the conveying means whereby said one end portion may be selectively positioned adjacent each of the material receiving means so that feed material deposited on the conveying means may be discharged into selective ones of the feed material receiving means.

2. The feed system set forth in claim 1 wherein the conveying means includes an elongate continuous belt, said one end portion being defined by a first roller means, said belt passing downwardly around said first roller means whereby feed material on the surface of said belt will be discharged therefrom, and second roller means, said belt also passing upwardly around the second roller means for defining the other end portion of the conveying means.

3. The feed system set forth in claim 2 and including arcuate track means lying in a generally horizontal plane, said transporter being mounted on said track means, said track means being concentric with the center of curvature.

4. The feed system set forth in claim 3 and including drive means for translating said belt around said first and second roller means.

5. The feed system set forth in claim 4 and including second drive means for moving the transporter in an arcuate path on said track means.

6. The feed system set forth in claim 5 wherein the transporter is generally arcuate.

7. The feed system set forth in claim 6 wherein that portion of the belt which defines the arcuate center portion is generally circular except for a gap between said end portions, the first and second roller means being disposed in the opposite sides of the gap.

8. The feed system set forth in claim 7 and including second conveying means mounted on said transporter for conveying feed material from said gap to the feed material receiving means.

9. The feed system set forth in claim 1 and including arcuate track means concentric with the center of curvature, said transporter being mounted on said track means for movement thereon to move the one end portion in a circular path adjacent the circular array of said feed receiving means, and drive means for moving the transporter in a circular path on said track means.

10. A feed system for a treatment furnace having a plurality of feed receiving means disposed in a generally circular array for receiving feed materials and delivering the same to spaced apart locations within the furnace, said feed system including:

an arcuate conveying means mounted adjacent said furnace and having a center of curvature coincident with the circular array of said feeding means, said conveying means including a support and conveyor belt means mounted on said support and movable thereon in a generally horizontal arcuate path which defines the arcuate shape of the conveying means, feeding means disposed adjacent the arcuate path of the conveyor belt means for depositing materials thereon, discharge means on the support means for defining a transition in the direction that the conveyor belt means moves so that feed material deposited on the conveyor belt means will be translated to the discharge means and discharged from the conveyor belt means, the support being rotatable about the center of curvature of the path that the conveyor belt means moves whereby said discharge means may be selectively positioned adjacent each of the material receiving means so that feed material deposited on the conveyor belt means may be discharged into selective ones of the feed material receiving means.

11. The feed system set forth in claim 10 wherein the conveyor belt means comprises an elongate continuous belt, said discharge means comprising a first roller means, said belt moving out of said generally horizontal path and around said first roller means whereby feed material on the surface of said belt will be discharged therefrom, and second roller means, said belt also passing around the second roller means for returning the same to said generally horizontal path.

12. An electric arc furnace having a roof, a plurality of openings disposed in said roof for receiving arc furnace electrodes therethrough, a plurality of feed receiving means disposed in said roof and having an upper opened end and a lower end opening into said furnace, said feed receiving means being arranged in a generally circular array in said furnace roof and between the outer periphery thereof and said electrodes, a transporter, arcuate conveying means mounted on said transporter and including a central portion having a center of curvature coincident with the center of the circular array of the feed receiving means and a pair of end portions, said conveying means being constructed and arranged to move feed material deposited on said central portion to one of said end portions and relative to said transporter, feeding means disposed adjacent the arcuate path of the conveying means for depositing material on the central portion thereof, said transported being movable in an arcuate path about the center of curvature of the central portion of the conveying means so that the one end portion of the conveying means may be selectively positioned adjacent each of the material receiving means so that material deposited on the conveying means may be discharged into selective ones of the material receiving means.

13. The arc furnace set forth in claim, 12 and including arcuate track means lying adjacent said furnace roof and in a generally horizontal plane, said transporter being supported on said track means, said track means being concentric with the center of curvature.

14. The arc furnace set forth in claim 13 wherein said conveying means includes belt means, drive means for translating said belt means on said transporter.

15. The feed system set forth in claim 14 and including second drive means for moving the transporter in a circular path on said track means.

16. The feed system set forth in claim 15 wherein the transporter is generally arcuate.

17. The feed system set forth in claim 16 wherein that portion of the belt means which defines the arcuate center portion is generally circular except for a gap between said end portions, first and second roller means disposed in the opposite sides of the gap, said belt means passing around said roller means to define the end portions of said conveying means.

18. The feed system set forth in claim 17 and including second conveying means mounted on said transporter for conveying feed material from the one end portion of said belt means to feed receiving means.

* * * * *